US006910486B2

(12) United States Patent
Makino et al.

(10) Patent No.: US 6,910,486 B2
(45) Date of Patent: Jun. 28, 2005

(54) ARTIFICIAL HAIR MATERIAL, HAIR RESTORING APPARATUS, AND HAIR RESTORING METHOD

(75) Inventors: Masahiro Makino, Tokyo (JP); Mayumi Sekizaki, Tokyo (JP); Makiko Tsuruma, Tokyo (JP)

(73) Assignee: Aderans Co., Ltd., Tokyo (JP)

( * ) Notice: Subject to any disclaimer, the term of this patent is extended or adjusted under 35 U.S.C. 154(b) by 187 days.

(21) Appl. No.: 10/181,711

(22) PCT Filed: Dec. 21, 2001

(86) PCT No.: PCT/JP01/11273

§ 371 (c)(1),
(2), (4) Date: Jul. 22, 2002

(87) PCT Pub. No.: WO02/051272

PCT Pub. Date: Jul. 4, 2002

(65) Prior Publication Data

US 2003/0000540 A1 Jan. 2, 2003

(30) Foreign Application Priority Data

Dec. 25, 2000 (JP) ..... 2000-392193

(51) Int. Cl.[7] ..... A41G 3/00
(52) U.S. Cl. ..... 132/201; 132/53
(58) Field of Search ..... 132/201, 53, 54, 132/55, 56

(56) References Cited

U.S. PATENT DOCUMENTS 5,072,745 A * 12/1991 Cheh ..... 132/201
5,357,986 A * 10/1994 Hargrett ..... 132/201
5,533,529 A * 7/1996 Ohno ..... 132/200
5,551,452 A * 9/1996 Barlow ..... 132/54
5,601,099 A * 2/1997 Mochizuki et al. ..... 132/201
5,634,478 A * 6/1997 Shakir ..... 132/201
5,775,341 A 7/1998 Abe et al.

FOREIGN PATENT DOCUMENTS

JP 2-264007 10/1980
JP 05156506 A * 6/1993 ..... A41G/3/00
JP 08092809 A * 4/1996 ..... A41G/5/00
JP 9-268414 10/1997
JP 10053910 A * 2/1998 ..... A41G/3/00
JP 11-131313 5/1999
JP 2001295121 A * 10/2001 ..... A41G/3/00

* cited by examiner

*Primary Examiner*—Todd E. Manahan

(74) *Attorney, Agent, or Firm*—Wenderoth, Lind & Ponack, L.L.P.

(57) ABSTRACT

An artificial hair restorer has a trunk hair with plural restoring hairs fixed to certain points of the trunk hair. A loop formed by folding one or two trunk hair(s) in two, and the original hair(s) passes(pass) through the loop. A knot is provided close to the tying end of the restoring hairs but opposite to the loop. A hair restoring method comprises inserting one or more original hair(s) into the loop of the trunk hair, and then fixing the trunk hair to a point in the vicinity of the original hair root.

12 Claims, 3 Drawing Sheets

ARTIFICIAL HAIR MATERIAL, HAIR RESTORING APPARATUS, AND HAIR RESTORING METHOD

FIELD OF THE INVENTION

This invention relates to an artificial hair restorer, a hair restoring apparatus and a hair restoring method for tying and fixing natural or artificial hairs on one or several original hair(s) of the head.

BACKGROUND OF THE INVENTION

It's been prevalent to wear wigs when the number of one's hair diminishes and he or she becomes thin on top by alopecia, a burn or a scald and so on. But wearing wigs is bothersome, and many methods for restoring the hair by tying artificial hairs to the remained original hairs as a base and then grooming to look natural have been invented and put to practical use these days. Commonly in these hair restorings, one or several artificial hairs of synthetic fibers are tied to one original hair of the head.

For example, in Japanese Patent Laid-Open Publication No. Showa 61-97409 discloses a hair restoring method wherein one or two artificial hair(s) is(are) fixed around one hair root of the original hair by using an adhesive or by Wa (overhand) knotting. But in this method, each of the original hair has to bear relatively large load since the artificial hairs are tied and fixed to its root with fingers. Furthermore, since the several artificial hairs are fixed in one place, the ball of knotting or adhesive yields so that one's hairs might entangle with a comb. Those are inconvenient.

Japanese Patent Laid-Open Publication No. Heisei 2-264005 discloses a hair restoring method in which some split hairs are glued to one trunk hair with an adhesive at certain intervals, and this trunk hair in turn is glued to the original hair with an adhesive (i.e. one trunk hair with some split hairs is glued around the original hair root). With this attachment method using the adhesive, the bonding work has to be done over again because of the deterioration in adhesive, and there's a limit in the number of the split hairs capable of gluing to the trunk hair.

Further, a hair restoring method in Japanese Utility Model Laid-open Publication No. Heisei 3-78019 comprises steps of making several loops at certain intervals with an artificial trunk hair, inserting an original hair through each of the loops, and fixing the loops to the original hair with an adhesive. The trunk hair is placed in the vicinity of the original hair roots along the skin of the head. In other words, it comprises steps of inserting the original hair through each of the loops and fixing the hair therebetween with an adhesive. However, with this method, since one trunk hair is glued to some adjoining original hairs, the comb may entangle with the trunk hair or the original hairs at the time of combing after hair restoring. This is inconvenient. A hair restoring method in Japanese Patent Publication No. Heisei 4-15285 comprises steps of arranging one or two thread-like supporting base (trunk hair) in a straight line along the skin of the head, transplanting the split hairs for restoring them to the thread-like supporting base uprightly, and adhering the base to the original hair with a special adhesive. With this hair restoring method wherein the thread-like supporting base to which the plural of spilt hairs are transplanted uprightly is arranged along the skin of the head, it is still inconvenient in hair combing because the comb may catch the supporting base. There are still other hair restoring methods in Japanese Patent Laid-Open Publication Nos. Heisei 5-156506, Heisei 7-173704 and Heisei 11-217715.

A hair restoring method in Japanese Patent Laid-Open Publication No. Heisei 5-156506 (Japanese Patent Publication No. Heisei 7-96722) comprises steps of making a knot with an original hair near the root thereof, and tying the restoring hair directly to the original hair between the skin and the knot. This tying step includes steps of tying many restoring hairs to a pipe, passing the original hair through the pipe, and adhering the restoring hairs to the original hair passing therethrough after moving them aside the pipe. However, the knotting of the original hair is so difficult that the original hair can be harmed.

The invention disclosed in Japanese Patent Laid-Open Publication No. Heisei 7-173704 relates to a hear fixing tool for attaching one restoring hair to the original hair. Thus, one or two restoring hair(s) folded in two is(are) loosely tied on a guidestick pipe, then the holding member which projects at the tip of the guide pipe 8 is fixed close to the original hair root. Finally the loosened knots of the restoring hair are moved along the guide pipe to adhere it with the original hair. With this method, since plural of restoring hairs are adhered to one original hair, the original hair has to bear large load. In addition, the number of the restoring hairs capable of adhering to one original hair is limited as well.

Further, the hair restoring method in Japanese Patent Laid-Open Publication No. Heisei 11-217715 relates to a method wherein the restoring hairs with cuticles are adhered to one original hair at certain intervals. As a result, more voluminous hair restoring can be obtained comparing to one with using one or two normal restoring hair(s). With this method, since plural of restoring hairs with cuticle are adhered to one original hair, the original hair has to bear large load, and therefore the plural number of the restoring hairs can not be adhered to the original hair after all.

Moreover, the invention disclosed in Japanese Patent No. 2951259 relates to a hairpiece made by putting the restoring hairs in flat, folding them in two, arranging the doubled parts, in belt-like fashion, and then curling these restoring hairs with the belt-like connecting part as their centers. The belt-like connection parts of this hairpiece are attached to the original hairs to get hair restoring effect. However, since big hairpiece is to be attached to plural of the original hairs in this case, people can easily see that the hair has been restored due to unusual appearance at the curled part of the restoring hair comparing to the original hair. This is a fault.

As mentioned above, the prior art hair restoring methods are to fit plural restoring hairs directly to the original hair or to put the trunk hair with some restoring hairs along the skin of the head and adhere some original hairs to this trunk hair with an adhesive. However, there still remain a lot of weak points as hair restoring methods.

SUMMARY OF THE INVENTION

An object of this invention is to provide an artificial hair restorer that can be fitted to original hair(s) easily and has a superior effect in hair restoring.

Another object of this invention is to provide a hair restoring apparatus that can easily tie the artificial hair restorer that consists of the trunk hairs, to which plural of restoring hairs are tied, to one or more original hairs.

Another object of this invention is provide a hair restoring method wherein the load to the original hair(s) is(are) lessened and hair restoring effect is securely obtained by tying the artificial hair restorer of trunk hairs with plural restoring hairs to one or several original hair(s).

The above objects are achieved by an artificial hair restorer consisting of a trunk hair with plural restoring hairs tied to a certain point thereof and a loop at its one end. An artificial hair restorer with plural restoring hairs tied to predetermined point, a loop at its one end and a knot close to the tying point end of said restoring hairs but opposite to said loop; or an artificial hair restorer wherein the loop is formed at the doubled parts of one to several trunk hair(s) or is provided by folding said trunk hair(s).

The above mentioned objects are achieved by a hair restoring method which includes attaching and fixing an artificial hair restorer to one or original hair(s) in the vicinity of its(their) root(s) by inserting the original hair(s) into a loop formed at one end of the trunk hair and fastening therebetween while plural of restoring hairs being fixed to the trunk hair. Alternatively, the method includes attaching and fixing the artificial hair restorer to one or more original hair(s) by adhering the hair restoring to the original hairs at the tying point.

Furthermore, the above mentioned object is achieved by a hair restoring method comprising steps of tying loosely an artificial hair restorer at a certain point on a fitting bar after inserting the fitting bar through the loop formed at the end of the artificial hair restorer The loosely-tied loop along the fitting bar to set aside the fitting bar so that the original hair(s), which passes(pass) through the ring at the end of the fitting bar having the bar part, passes(pass) through the loop of the artificial hair restorer. Both ends of this artificial trunk hair oppositely to tightly tie the artificial hair restorer to the original hair(s).

This invention relates to a hair restoring apparatus having a fitting bar and a thread like line provided at one end of the fitting bar to make a ring through which one or plural original hair(s) passes(pass), said fitting bar is to be inserted through a loop of an artificial hair restorer of a trunk hair, to whose one end plural restoring hairs are tied, or a loop of an artificial hair restorer formed at the turn of the folded trunk hair, to whose one end plural restoring hairs are tied.

The fitting bar is inserted trough the loop or loose tie part of the trunk hair of the artificial hair restorer so that this artificial hair restorer is loosely tied thereon. The present hair restoring apparatus is obtained by repeating the above at the plural positions spaced apart at certain intervals.

In the artificial hair restorer according to the present invention, as one trunk hair is tied to plural, i.e. several to dozens of restoring hairs and has a loop at one end, it is very easy to mount this loop to the fitting bar. Furthermore, it is easy to tie and fix the artificial hair restorer to the 1–4 original hairs by the hair restoring apparatus to which many artificial hair restorers are mounted, and therefore hair restoring is simple. And when the knot is formed outside and opposite to the loop that is at the end of the connecting point of the restoring hairs to the artificial trunk hair, the restoring hairs can be prevented from falling out.

The hair restoring method according to the present invention comprises the steps of inserting the bar part or part of the fitting bar through the loop of the 1–2 trunk hair(s) of the artificial hair restorer to which several to dozens of the restoring hairs are fixed, loosely tying the plural artificial hair restorers to the fitting bar, sliding this loop along and off the bar part to the ring of its end, making it tangled with and tightly tying to the original hair(s) which is(are) inserted through the thread-like line which makes the ring at the bar part. Therefore the artificial hair restorer isn't only adhered to the original hair with an adhesive, but also tied and fixed to the original hair root by using its loop. In this manner, since plural restoring hairs can be fixed to one or more original hair(s), the hair with the restoring hairs looks voluminous. And furthermore, it is not need to fear that the adhesive melts into the water at the time of shampooing, which results in fallen hairs, because the artificial hair restorer having the restoring hairs is tied and fixed to the original hair.

BRIEF DESCRIPTION TO THE DRAWINGS

THE BEST MODE CARRYING OUT THE INVENTION

Now, detailed explanation will be made with reference to the drawings showing preferred embodiments of the artificial hair restorer and the hair restoring method according to the present invention.

Figure 1:
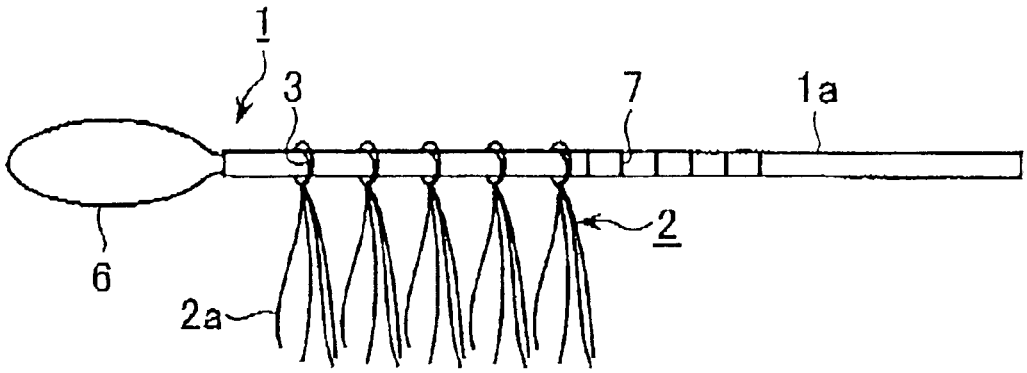
FIG. 1 is a plan view of an embodiment of a hair restoring apparatus adopted in the hair restoring method according to the present invention.
Figure 2:
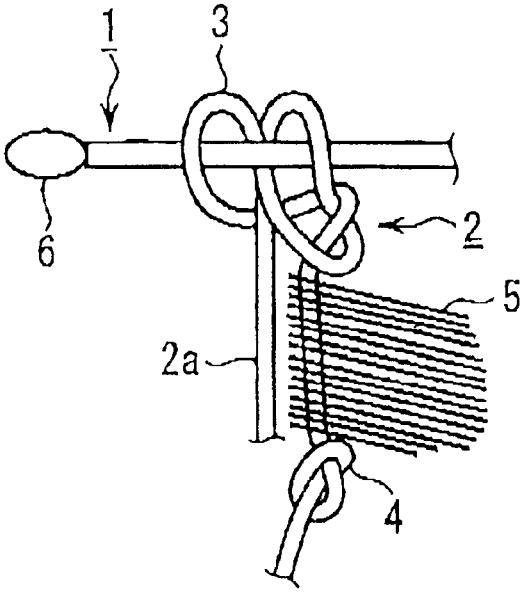
FIG. 2 is a pictorial view explaining how the artificial hair restorer is tied to the fitting bar of the hair restoring apparatus.
Figure 3A:
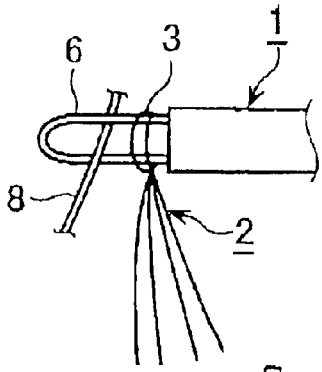
FIGS. 3A–3D are pictorial views for explaining a method for tying and fixing the artificial hair restorer to the original hair by using the hair restoring apparatus according to the present invention.
Figure 3B:
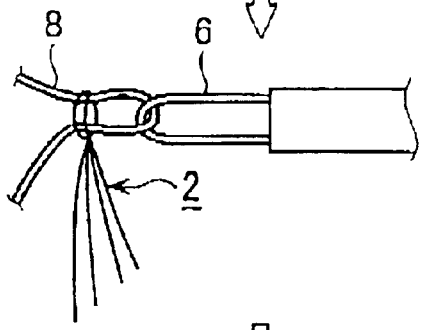
Figure 3C:
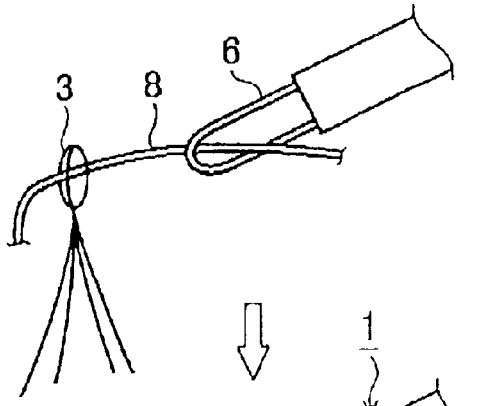
Figure 3D:
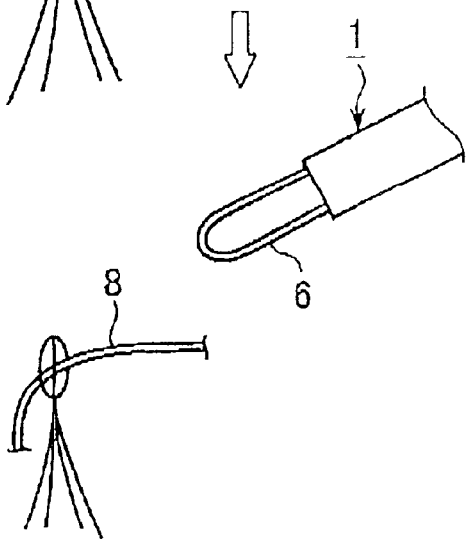

A hair restoring apparatus illustrated in FIG. 1 has plural of artificial hair restorers 2 loosely tied at a certain interval to the outer periphery of the fitting bar 1. The fitting bar with a bar part 1*a* is a fitting tool which is like a plastic straw or bar member. Plural restoring hairs 5 are tied and fixed to the trunk hair 2*a* that is a part of the artificial hair restorer 2. A loop 3 formed at the turn of the trunk hair 2*a*, and is loosely tied to the fitting bar 1. The way of tying, as shown in FIG. 2, forms the loop 3 at the turn of one trunk hair 2*a*, and the artificial hair restorer 2 is loosely tied to the fitting bar 1 so as to make the loop 3 is formed around the fitting bar 1. In this case, to prevent the tying parts of the hair of the hair restores 2 arranged at a certain interval from getting entangled, plural grooves 7 are formed on the outer surface of the bar part 1*a* of the fitting bar 1, which avoids the loosely tying knots from moving aside easily. This fitting bar 1 can be as a bar, but it's convenient to use if it's tubular in form.

To the trunk hair 2*a* of this artificial hair restorer 2, the knot 4 is formed at one side and plural restoring hairs 5 are tied and fixed between this knot 4 and the loop 3. Each trunk hair 2*a* of this artificial hair restorer 2 can be one string of an artificial hair. However, it's better to bind two of them together with an adhesive. The trunk hair 2*a* made by tying this way gets its adhesive melted at the time of shampooing, so that it loosens and goes back to two hairs bringing a lot for the effect of hair restoring. No restoring hair 5 are tied to the opposite end side of the turn of the trunk hair 2*a* of this artificial hair restorer 2. The both ends of the thread-like nylon line 6, which forms a ring, are fixed to the end of the fitting bar 1. Especially if the bar part 1*a* of the fitting bar 1 is formed as a pipe, the both ends of the thread-like line 6 can be inserted inside of the pipe and fixed, and the loose loop or knot can be slide or moved laterally. This thread-like line 6 is preferably to be made of synthetic fiber. The original hair(s) 8 is(are) inserted in the ring of the thread-like line 6.

The restoring hairs 5 fixed to the trunk hair 2*a* are tied being folded in two. Each restoring hair 5 is to be as thick as the original hair 8, i.e. about 0.08 mm thick. The ratio of the restoring hairs to the original hair 8 can be properly adjusted according to the state of the fallen hairs (i.e., the thinness of the original hair). The number of the restoring hairs 5 fixed to one trunk hair 2*a* is not fixed, but the number that is easiest to fit is about ten (i.e. twenty restoring hairs 5) extend from the trunk hair 2*a* of the artificial hair restorer 2, because they are folded in two. The number of the restoring hairs is not limited to this number, so twenty of them or forty of them by folding in two again is also acceptable with taking the effect of hair restoring as a whole into consideration. These artificial hair restorers 2 are arranged and loosely tied at a certain interval to the bar part 1*a* of the fitting bar 1 as shown in FIG.1. Reference number 10 illustrates the skin of the head.

A hair restoring method with using the hair restoring apparatus of the fitting bar 1, to which the artificial hair restorers 2 with plural restoring hairs 5 are loosely tied, will be explained as follows.

As shown in FIG. 3, the method comprises the steps of making one to four of the original hairs 8 (after putting them together when a plurality of hairs is used) through the ring of the thread-like line 6 which is formed at the end of the bar part 1*a* of the fitting bar 1. The loop 3 of the artificial hair restorer 2, which is loosely tied to the bar part 1*a* of the fitting bar, is picked up with the fingers, moving it along the bar part 1*a* to the ring of the thread-like line 6 (FIG. 3*a*), and drawing the original hair(s) 8 into the loop 3 of the artificial hair restorer 2 by pulling the fitting bar 1 so that the original hair(s) 8 is(are) folded in two at the loop 3 (FIG. 3*b*). The original hair(s) is (are) unfolded to let the free end of the original hair(s) 8 protrude out of the loop (FIG. 3*d*). The number of the original hairs to be passing through this loop isn't limited, but one to four is proper, for the knot will be too big with more than eight of them.

Figure 4:
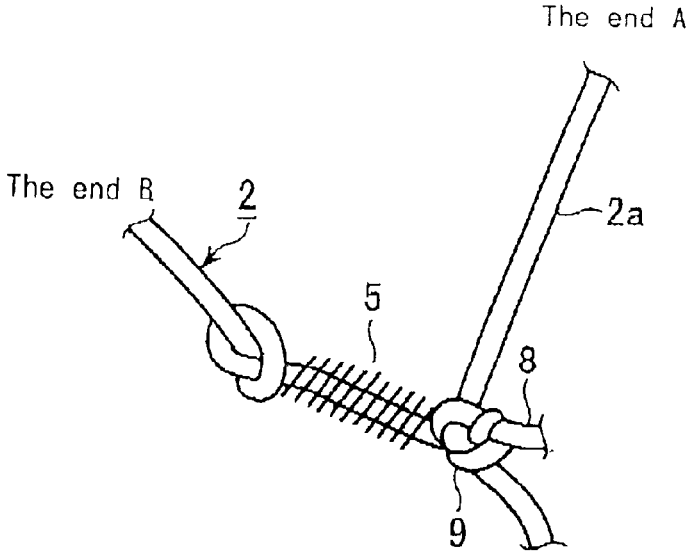
FIG. 4 is the enlarged plan view for showing the connecting part of the original hair and the artificial hair restorer with using a hair restoring method according to the present invention.
Figure 5:
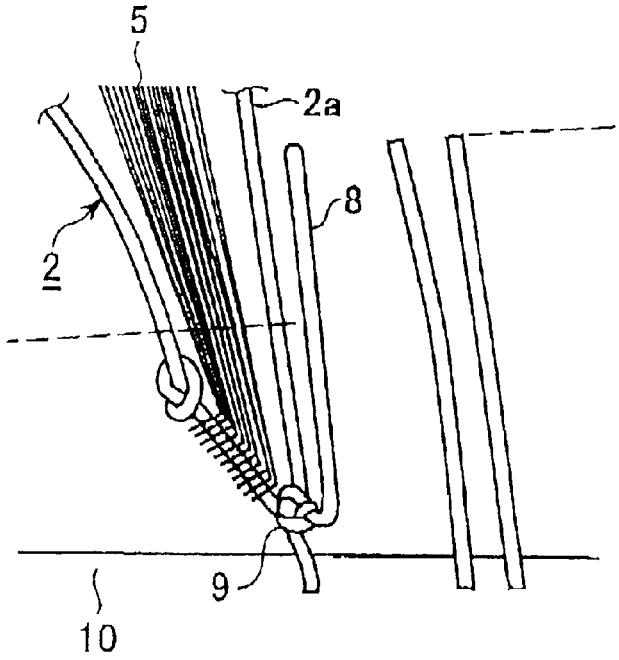
FIG. 5 is the rough pictorial view showing the skin of the head to be restored hairs by this invention.

The artificial hair restorer 2 down to the point close to the root of the original hair(s) 8, tying the artificial hair restorer 2 to the original hair(s) 8 as shown in the FIG. 4, and pulling the ends A and B in the opposite direction to get the knot 9 stiffer and tying the artificial hair restorer 2 with plural restoring hairs 5 to the original hair(s) 8. After restoring the hair partially by fitting the artificial hair restorer 2 to some points of the original hair(s) 8 in this way, the tips are trimmed with a cutting tool as scissors to unify the length of the original hairs 8 and the restoring hair 5 (a dotted line in FIG. 5).

If needed, adhesive is applied at the knot 9 of the artificial hair restorer 2 and the original hair(s) 8 and is hardened after predetermined time of curing to firmly secure the artificial hair restorer 2 to the original hair(s) 8. The adhesive force decreases after certain days due to fat from the cortex or sweat and therefore it needs to loosen the knot 9 and get it down to the point close to the root of the original hair(s) 8 again.

In this way, the hair restoring method of the present invention capable of fitting and tying plural restoring hairs to the original hair(s) with the simple hair restoring apparatus, to restore the hair entirely voluminous by tying a lot of artificial hair restorers 2 to adjoining original hairs.

INDUSTRIAL POSSIBILITY OF THE INVENTION

Because it ties a few to dozens of restoring hairs to its trunk hair, the artificial hair restorer of the present invention capable of restoring the hair voluminously when it is fixed to the original hair(s), and is very effective to the whole hair restoring of the head. Furthermore, it is possible to tie and fix them to the original hair(s) with a simple hair restoring apparatus.

The hair restoring method of the present invention capable of fixing the artificial hair restorer, that has the trunk hair to which plural restoring hairs are tied and fixed, to the points close to the original hair root easily. It is capable of doing voluminous hair restoring without putting any excessive load to the original hair as the artificial hair restorer is tied only to one point of the original hair.

What is claimed is:

1. An artificial hair restorer comprising:

a trunk hair having a loop that is designed to be drawn closed around original hair so as to join the original hair to said trunk hair; and plural restoring hairs tied to said trunk hair at positions along the length of said trunk hair.

2. The artificial hair restorer defined in claim 1, wherein said trunk hair has a knot close to the tying points of said plural restoring hairs but opposite to said loop.

3. The artificial hair restorer defined in claim 2, wherein said trunk hair comprises one or two hairs folded in two to form a folding turn, with said loop being at said folding turn.

4. The artificial hair restorer defined in claim 1, wherein said trunk hair comprises one or two hairs folded in two to form a folding turn, with said loop being formed at said folding turn.

5. A hair restoring method comprising:

tying and fixing an artificial hair restorer to at least one original hair by (i) forming a loop in a trunk hair of said artificial hair restorer, (ii) tying plural restoring hairs to said trunk hair at positions along the length of said trunk hair;

(iii) inserting said at least one original hair into said loop, and (iv) fastening said loop to said at least one original hair, at a vicinity of a root of said at least one original hair, by drawing said loop closed around said at least one original hair.

6. The hair restoring method defined in claim 5, further comprising:

adhering said artificial hair restorer to said at least one original hair at said loop after having been drawn closed around said at least one original hair.

7. The hair restoring method defined in claim 6, further comprising:

loosely positioning said loop in a groove formed on an outer surface of a bar part of a fitting bar; and sliding this loosely positioned loop along said fitting bar after passing said at least one original hair through a ring at a first end of said fitting bar, wherein drawing said loop closed around said at least one original hair comprises pulling ends of said trunk hair in opposite directions.

8. The hair restoring method defined in claim 5, further comprising:

loosely positioning said loop in a groove formed on an outer surface of a bar part of a fitting bar; and sliding this loosely positioned loop along said fitting bar after passing said at least one original hair through a ring at a first end of said fitting bar, wherein drawing said loop closed around said at least one original hair comprises pulling ends of said trunk hair in opposite directions.

9. A hair restoring apparatus comprising:

a fitting bar having a thread like line formed into a ring at one end of said fitting bar through which at least one original hair is to pass, said fitting bar further having a bar part; and artificial hair restorers arranged along an outer surface of said bar part, each of said artificial hair restorers including one or two trunk hairs having plural restoring hairs tied thereto at positions alone lengths thereof, and said one or two trunk hairs having a loop that is designed to be drawn closed around original hair so as to join the original hair to said one or two trunk hairs, and is also designed to have said bar part be inserted therethrough.

10. The hair restoring apparatus defined in claim 9, wherein said one or two trunk hairs are folded in two to form a folding turn, with said loop being located at said folding turn.

11. A The hair restoring apparatus defined in claim 10, wherein said one or two trunk hairs have a knot close to said plural restoring hairs but opposite to said loop.

12. The hair restoring apparatus defined in claim 9, wherein said one or two trunk hairs have a knot close to said plural restoring hairs but opposite to said loop.

* * * * *